US006602361B2

(12) United States Patent
Warner et al.

(10) Patent No.: US 6,602,361 B2
(45) Date of Patent: Aug. 5, 2003

(54) PRODUCT MADE OF AN ALCUMG ALLOY FOR AIRCRAFT STRUCTURAL ELEMENTS

(75) Inventors: Timothy Warner, Voreppe (FR); Philippe Lassince, Issoire (FR); Philippe Lequeu, Issoire (FR)

(73) Assignee: Pechiney Rhenalu, Paris (FR)

( * ) Notice: Subject to any disclaimer, the term of this patent is extended or adjusted under 35 U.S.C. 154(b) by 0 days.

(21) Appl. No.: 09/479,924

(22) Filed: Jan. 10, 2000

(65) Prior Publication Data

US 2002/0014288 A1 Feb. 7, 2002

(30) Foreign Application Priority Data

Feb. 4, 1999 (FR) ..... 99 01468
Aug. 18, 1999 (FR) ..... 99 10682

(51) Int. Cl.[7] ..... C22C 21/06

(52) U.S. Cl. ..... 148/417; 420/533; 420/543; 420/553

(58) Field of Search ..... 148/417; 420/532, 420/533, 535, 543, 553

(56) References Cited

U.S. PATENT DOCUMENTS 3,826,688 A * 7/1974 Levy et al ..... 148/2
5,213,639 A * 5/1993 Colvin et al. ..... 148/693
5,759,302 A 6/1998 Nakai et al.
5,863,359 A 1/1999 Karabin et al.
6,077,363 A * 6/2000 Heymes et al. ..... 148/417
6,325,869 B1 * 12/2001 Liu et al. ..... 148/439

FOREIGN PATENT DOCUMENTS

| | | |
|---|---|---|
| EP | 0031605 | 7/1981 |
| EP | 0038605 | 10/1981 |
| EP | 0473122 | 3/1992 |
| EP | 0489408 | 6/1992 |
| EP | 731185 | 9/1996 |

OTHER PUBLICATIONS

"Metals Handbook: Desk Edition", 2nd ed, ASM International, (1998), pp. 427–428, 445–446, 462–463.*

* cited by examiner

*Primary Examiner*—George Wyszomierski
*Assistant Examiner*—Janelle Combs Morillo
(74) *Attorney, Agent, or Firm*—Dennison, Schultz & Dougherty

(57) ABSTRACT

Rolled product for use in the manufacture of aircraft structural elements, made of an AlCuMg alloy processed by solution heat treatment, quenching and cold stretching. The product has a composition consisting essentially of, in % by weight: Fe<0.15; Si<0.15; Cu:3.8–4.4; Mg:1–1.5; Mn:0.5–0.8; Zr:0.08–0.15; other elements: <0.05 each and <0.15 total. This product has a thickness of between 6 and 60 mm, with an ultimate tensile strength $R_{m(L)}$ in the quenched and stretched temper >475 MPa and yield stress $R_{0.2}(L)$>370 MPa, with a ratio $R_{m(L)}/R_{0.2}(L)$>1.25.

9 Claims, No Drawings

PRODUCT MADE OF AN ALCUMG ALLOY FOR AIRCRAFT STRUCTURAL ELEMENTS

FIELD OF THE INVENTION

This invention relates to rolled, extruded or forged products made of a quenched and stretched AlCuMg alloy designed for the manufacture of aircraft structural elements, particularly skin panels and lower wing stringers, and with an improved compromise between mechanical strength, formability, toughness, tolerance to damage and residual stress properties than is available with products according to prior art used for the same application. Designations of alloys and metallurgical tempers are in accordance with the terminology used by the Aluminum Association, and repeated in European standards EN 515 and EN 573.

DESCRIPTION OF RELATED ART

Wings for high capacity commercial aircraft comprise an upper part (upper wing) composed of a skin made of thick 7150 alloy plates in tempers T651, or 7055 alloy plates in temper T7751 or 7449 alloy plates in temper T7951, and stringers made from profiles of the same alloy, and a lower part (lower wing) composed of a skin made of thick plates made of a 2024 alloy in temper T351 or a 2324 alloy in temper T39, and stringers made from profiles of the same alloy. The two parts are assembled by spars and ribs.

The chemical composition of 2024 alloy according to the terminology used by the Aluminum Association and standard EN 573-3 is as follows (% by weight):

Si<0.5 Fe<0.5 Cu:3.8–4.9 Mg:1.2–1.8 Mn:0.3–0.9 Cr<0.10 Zn<0.25 Ti<0.15

Different variants have been developed and registered with the Aluminum Association as 2224, 2324 and 2424, particularly with lower contents of silicon and iron. Alloy 2324 in temper T39 was described in Boeing patent EP 0038605 (=U.S. Pat. No. 4,294,625), in which the improvement to the yield stress is obtained by work hardening by a cold rolling pass after quenching. This work hardening tends to reduce the toughness, and the contents of Fe, Si, Cu and Mg are reduced in order to compensate the drop in toughness. Boeing also developed alloy 2034 with composition:

Si<0.10 Fe<0.12 Cu: 4.2–4.8 Mg:1.3–1.9 Mn: 0.8–1.3 Cr<0.05 Zn<0.20 Ti<0.15 Zr:0.08–0.15

This alloy is described in patent EP 0031605 (=U.S. Pat. No. 4,336,075). Compared with alloy 2024 in temper T351, it has a better specific yield stress due to an increase in the manganese content and the addition of another anti-recrystallizing agent (Zr), and also has improved toughness and fatigue strength.

Alcoa patent EP 0473122 (=U.S. Pat. No. 5,213,639) describes an alloy, recorded by the Aluminum Association as 2524, with composition:

Si<0.10 Fe<0.12 Cu: 3.8–4.5 Mg: 1.2–1.8 Mn:0.3–0.9 that can also contain an other anti-recrystallizing agent (Zr, V, Hf, Cr, Ag or Sc). This alloy is intended specifically for thin plates for fuselages and its toughness and resistance to crack propagation are improved compared with 2024.

Patent application EP 0731185 made by the applicant relates to an alloy, subsequently registered as 2024A with composition:

Si<0.25 Fe<0.25 Cu:3.5–5 Mg:1–2 Mn<0.55 satisfying the relation: 0<Mn-2Fe<0.2

The thick plates made of this alloy are tougher and residual stresses are lower, without any loss of other properties.

Alcoa patents U.S. Pat. No. 5,863,359 and U.S. Pat. No. 5,865,914 relate to an aircraft wing with a lower wing made of an alloy with composition:

Cu:3.6–4 Mg:1–1.6 (preferably 1.15–1.5)

Mn:0.3–0.7 preferably 0.5–0.6), Zr:0.05–0.25 and preferably Fe<0.07 and Si<0.05 with the following properties:

$R_{0.2}$(LT)>60 ksi (414 MPa) and $K_{ie}$(L-T)>38 ksi√inch (42 MPa√m), and a process for manufacturing a lower wing element with $R_{0.2}$(LT)>60ksi comprising casting of an alloy with the previous composition, homogenization between 471 and 482° C., hot transformation at a temperature >399° C.; solution heat treatment above 488° C., quenching cold work hardening preferably by more than 9% and stretching by at least 1%.

One essential constraint when constructing new high capacity commercial aircraft is to limit the weight, such that manufacturer specifications impose higher typical stresses for wing panels, which leads to higher minimum values for static mechanical properties and higher damage tolerance for the aluminum alloy products used. The use of work hardened products in temper T39, as recommended in U.S. Pat No. 5,863,359 and U.S. Pat. No. 5,865,914, does give higher yield stresses $R_{0.2}$, but it also has a number of disadvantages for other working properties that are important in this application. One result is a very small plastic range, in other words the difference between the ultimate stress $R_m$ and the yield stress $R_{0.2}$, which results in lower cold formability and less resistance to crack propagation under a load with a variable amplitude. The reduction in the rate of crack propagation after a partial overload is less important if the plastic range is small.

Furthermore, large parts must be machined without distortion in thicker plates, which requires better control of residual stresses. However, temper T39 is not particularly advantageous from this point of view.

Therefore the purpose of this invention is to provide AlCuMg alloy products in the work hardened and cold deformed temper, for use in manufacturing aircraft lower wings, and providing a better compromise of all working properties (mechanical strength, rate of crack propagation, toughness, resistance to fatigue and residual stresses) than is possible with similar products according to prior art.

SUMMARY OF THE INVENTION

The purpose of the invention is a rolled, extruded or forged product made of an AlCuMg alloy processed by solution heat treatment, quenching and cold stretching, to be used in the manufacture of aircraft structural elements, with the following composition (% by weight):

Fe<0.15 Si<0.15 Cu:3.8–4.4 (preferably: 4.0–4.3) Mg:1.0–1.5 Mn: 0.5–0.8 Zr:0.08–0.15 other elements: <0.05 each and <0.15 total with a ratio $R_m(L)/R_{0.2}$ (L) of the ultimate tensile strength in the L direction to the yield stress in the L direction exceeding 1.25 (and preferably exceeding 1.30).

Another purpose is a rolled product (plate) with the same composition and between 6 and 60 mm thick and with at least the following groups of properties in the quenched and stretched temper:

a) Ultimate tensile strength $R_{m(L)}$>475 MPa and yield stress $R_{0.2(L)}$>370 MPa b) Plastic range $R_m$-$R_{0.2}$ in the L and TL directions >100 MPa.

c) Critical intensity factor (L-T direction) $K_c$>170 MPa√m and $K_{co}$>120 MPa√m (measured according to ASTM standard E 561 on notched test pieces sampled at a quarter thickness with parameters B=5 mm, W=500 and $2_{B0}$=165 mm)

d) Crack propagation rate (L-T direction) da/dn, measured according to ASTM standard E 647 on notched test pieces sampled at a quarter thickness with parameters W=200 mm and B=5 mm)<$10^{-4}$ mm/cycle for ΔK=10 MPa√m <2.5 $10^{-4}$ mm/cycle for ΔK=15 MPa√m and <5 $10^{-4}$ mm/cycle for ΔK=20 MPa√m This plate also has residual stresses such that the deflection f measured in the L and TL directions after machining a bar supported on two supports separated by a length 1 to its mid-thickness, is such that:

f<(0.14 $l^2$)/e, where f is measured in microns, e is the thickness of the plate and l is the length measured in mm.

Another purpose of the invention is a process for manufacturing a rolled, extruded or forged product comprising the following steps:

cast a plate or billet with the indicated composition, homogenize this plate or billet between 450 and 500° C., hot transformation, and possibly cold transformation, until the required product is obtained, solution heat treatment at a temperature of between 480 and 505° C., quench in cold water, cold stretching to at least 1.5% permanent deformation, natural aging under ambient conditions.

DETAILED DESCRIPTION OF THE INVENTION

The chemical composition of the product is different from the chemical composition of the usually used 2024 in that the iron and silicon contents are lower, the manganese content is higher, and zirconium is added. Compared with 2034, the magnesium content is lower and the copper content is slightly lower. Compared with the composition of the alloys described in U.S. Pat. No. 5,863,359 and U.S. Pat. No. 5,865,914, the copper content is higher, compensating the lower work hardening after quenching, for the mechanical strength. Surprisingly, this narrow composition range (particularly for manganese) combined with modifications to the manufacturing procedure, can give a significant improvement in the compromise between the mechanical strength, elongation and damage tolerance under operating conditions for a high capacity civil aircraft, compared with prior art. Furthermore, and quite unexpectedly, low residual stresses are observed particularly for thick products, so that large parts can be machined without distortion.

The manufacturing process consists of casting the plates in the case in which the product to be made is a rolled plate, or the billets in the case of an extruded profile or forged part. The plate or the billet is scalped and then homogenized at between 450 and 500° C. The hot transformation is then made by rolling, extrusion or forging. This transformation is preferably made at a temperature higher than temperatures normally used, the output temperature being greater than 420° C. and preferably greater than 440° C. so that the treated product has a slightly recrystallized structure, with a recrystallization rate of less than 20%, and preferably less than 10%, at a quarter thickness. The rolled, extruded or forged semi-product is then put into solution heat treatment at between 480 and 505° C., such that solution heat treatment is as complete as possible, in other words that the maximum number of potentially soluble phases, and particularly $Al_2Cu$ and $Al_2CuMg$ precipitates, are actually in solid solution. The quality of the solution heat treatment may be evaluated by differential enthalpic analysis (AED) by measuring the specific energy using the area of the peak on the thermogram. This specific energy must preferably be less than 2 J/g.

Quenching is then done with cold water, followed by controlled stretching to give a permanent elongation of not less than 1.5%. Finally, the product is aged naturally at ambient temperature.

Products according to the invention have significantly improved static mechanical properties compared with alloy 2024-T351, currently used for aircraft lower wings, and only slightly lower than the properties of 2034-T351. The high plastic range and elongation of the material give excellent cold formability. The toughness, measured by critical stress intensity factors in plane stress $K_c$ and $K_{co}$ is greater than the toughness of 2024 and 2034 by more than 10%, and the crack propagation rate da/dn is significantly better than these two alloys, particularly for high values of ΔK, and for loads with variable amplitude. Fatigue lives measured on notched samples taken at mid-thickness in the L direction are also more than 20% better than with 2024 and 2034. Finally, the magnitude of residual stresses measured by the deflection f after machining a bar supported on two supports separated by distance 1 to half its thickness, is fairly low, although the opposite might have been expected with a fibrous structure. This deflection, measured in microns, is always less than the quotient (0.14 $l^2$)/e, where the length l and the thickness e of the plate are expressed in mm.

All these properties mean that products according to the invention are particularly suitable for manufacturing aircraft structural elements, particularly lower wings, but also profiles for a wing spar box, assembled spar booms and rib flanges and fuselage skins and stringers.

EXAMPLES

Three 1450 mm wide and 446 mm thick plates were cast, made of 2024, 2034 alloys and the alloy according to the invention, respectively. The chemical compositions (% by weight) of the alloys are as given in Table 1:

TABLE 1

| Alloy | Si | Fe | Cu | Mg | Mn | Zr |
|---|---|---|---|---|---|---|
| 2024 | 0.12 | 0.20 | 4.06 | 1.36 | 0.54 | 0.002 |
| 2034 | 0.05 | 0.07 | 4.30 | 1.34 | 0.98 | 0.104 |
| Invention | 0.06 | 0.08 | 4.14 | 1.26 | 0.65 | 0.102 |

The plates were scalped, and then homogenized under the following conditions:

For the 2024, 2 h at 495° C. then 5 h at 460° C.

For the 2034, 5 h at 497° C.

For the alloy according to the invention, the temperature was increased in 12 h and kept for 6 h at 483° C.

A part of the plates was then hot rolled to a thickness of 40 mm by successive passes of the order of 20 mm. Another part of the plates was hot rolled to 15 mm. For the alloy according to the invention, the hot rolling entry temperature was 467° C., the exit temperature at 40 mm was equal to 465° C. and at 15 mm was 444° C.

Plates were put into solution heat treatment under the following conditions:

3 h and 6 h at 497° C. for 2024 plates with thicknesses equal to 15 and 40 mm respectively, 2 h and 5 h at 499° C. for 2034 plates with thicknesses equal to 15 and 40 mm, 9 h at 497° C. for plates according to the invention.

After quenching in cold water, all plates were subjected to controlled stretching to give a permanent elongation of 2%.

The static mechanical characteristics in the L and TL directions were then measured, to determine the ultimate stress $R_m$ (in MPa), the conventional yield stress at 0.2% $R_{0.2}$ (in MPa) and elongation at failure A (in %). The results are given in table 2:

TABLE 2

| Alloy | Thickness | Direction | $R_m$ | $R_{0.2}$ | A |
|---|---|---|---|---|---|
| 2024 | 40 | L | 468 | 362 | 20.0 |
| 2024 | 40 | TL | 469 | 330 | 17.4 |
| 2024 | 15 | L | 462 | 360 | 21.2 |
| 2024 | 15 | TL | 467 | 325 | 17.6 |
| 2034 | 40 | L | 534 | 416 | 11.2 |
| 2034 | 40 | TL | 529 | 393 | 12.0 |
| 2034 | 15 | L | 548 | 431 | 13.8 |
| 2034 | 15 | TL | 531 | 395 | 14.6 |
| Invention | 40 | L | 510 | 384 | 15.4 |
| Invention | 40 | TL | 475 | 336 | 18.9 |
| Invention | 15 | L | 501 | 390 | 16.7 |
| Invention | 15 | TL | 491 | 351 | 19.1 |

The toughness was also measured by critical intensity factors in plane stress $K_c$ and $Ke_0$ (in MPa√m) in the L-T direction according to ASTM standard E 561, on CCT test pieces sampled at quarter thickness, with width W=500 mm and thickness B=5 mm, and a central notch machined by electroerosion $2a_0$=165 mm, enlarged to 170 mm by a fatigue test. Table 3 contains the results:

TABLE 3

| Alloy | Thickness | $K_c$ | $K_{c0}$ |
|---|---|---|---|
| 2024 | 40 | 143.4 | 105.2 |
| 2034 | 40 | 128.8 | 97.8 |
| Invention | 40 | 179.7 | 122 |
| 2034 | 15 | 136.4 | 103.7 |
| Invention | 15 | 173.6 | 124.3 |

The fatigue crack propagation rate da/dn was also measured in the L-T direction (in mm/cycle) for different values of the ΔK (in MPa√m) according to ASTM standard E 647. This was done using two CCT samples with width W=200 mm and thickness B=5 mm, sampled at a quarter-plate thickness in the L-T direction. The length of the central notch machined by electroerosion is 30 mm, and this notch is enlarged by the fatigue test to 40 mm. The crack rate measurement test is carried out on an MTS machine with a load at R=0.05 and a stress of 40 MPa, calculated to give a value of ΔK equal to 10 MPa√m for the initial notch length of 40 mm (results in table 4).

TABLE 4

| Alloy | Thickness | ΔK = 10 | ΔK = 12 | ΔK = 15 | ΔK = 20 | ΔK = 25 |
|---|---|---|---|---|---|---|
| 2024 | 40 | $9\ 10^{-5}$ | $1.5\ 10^{-4}$ | $3.0\ 10^{-4}$ | $6\ 10^{-4}$ | $9\ 10^{-4}$ |
| 2034 | 40 | $8\ 10^{-5}$ | $1.5\ 10^{-4}$ | $3\ 10^{-4}$ | $5.7\ 10^{-4}$ | $1.7\ 10^{-3}$ |
| Invention | 40 | $5.5\ 10^{-5}$ | $1.7\ 10^{-4}$ | $2.0\ 10^{-4}$ | $4.0\ 10^{-4}$ | $7.8\ 10^{-4}$ |
| 2034 | 15 | $8\ 10^{-5}$ | $1.5\ 10^{-4}$ | $3\ 10^{-4}$ | $5.2\ 10^{-4}$ | $2.1\ 10^{-3}$ |
| Invention | 15 | $4.9\ 10^{-4}$ | $6.0\ 10^{-4}$ | $1.3\ 10^{-4}$ | $2.5\ 10^{-4}$ | $5.4\ 10^{-4}$ |

Fatigue tests according to the Airbus specification AITM 1-0011 were carried out on 7.94 mm thick perforated test pieces 230 mm long, 50 mm wide, sampled at mid-thickness in the plate in the L direction. The hole diameter is 7.94 mm. An average stress of 80 MPa on the solid test pieces was applied with four alternating stress levels; 85 MPa, 55 MPa, 45 MPa and 35 MPa for 40 mm plates, and with stresses of 110, 85, 55 and 45 MPa for 15 mm plates, with 2 test pieces per level. The average life values (as a number of cycles) are given in table 5. It is found that the fatigue life is more than 20% better than with alloy 2024, with a notch factor $K_t$=2.5.

TABLE 5

| Alloy | Thickness mm | 80 ± 85 MPa | 80 ± 55 MPa | 80 ± 45 MPa | 80 ± 35 MPa |
|---|---|---|---|---|---|
| 2024 | 40 | 36044 | 159721 | | |
| 2034 | 40 | 30640 | 125565 | 340126 | 839340 |
| Invention | 40 | 42933 | 219753 | 392680 | 1018240 |
| 2034 | 15 | 41040 | 204038 | 352957 | |
| Invention | 15 | 45841 | 241932 | 429895 | |

Finally, the deflections f in the L and TL direction were measured, together with the recrystallization rate (in %) at the surface, at a quarter thickness and at half-thickness, determined by image analysis after chemical etching of the sample.

The deflection f is measured as follows. Two bars are taken from the plate with thickness e, one called the L direction bar with length b in the direction of the length of the plate (L direction), 25 mm wide in the direction of the width of the plate (TL direction) and with thickness e equal to the full thickness of the plate (TC direction), the other bar being called the TL direction bar with dimensions of 25 mm in the L direction, b in the TL direction and e in the TC direction.

Each bar is machined down to half-thickness and the deflection at mid-length of the bar is measured. This deflection is representative of the internal stresses in the plate and its ability to not deform during machining. The distance 1 between supports was 180 mm and the length b of the bars was 200 mm. Machining was done mechanically and progressively with passes of about 2 mm. The deflection at mid-length was measured using a dial gauge with a resolution of one micron. The results of the deflections and recrystallization rates are shown in table 6.

TABLE 6

| Alloy | Thick-ness | $f_L$ (μm) | $f_{TL}$ (μm) | Work hard. ratio (surf.) % | Work hard. ratio (¼ t) % | Work hard. ratio (½ t) % |
|---|---|---|---|---|---|---|
| 2024 | 40 | 210 | 120 | 79 | 58 | 30 |
| 2034 | 40 | 147 | 129 | 12 | 0 | 0 |
| Inven-tion | 40 | 86 | 75 | 46 | 5 | 2 |

What is claimed is:

1. Product for use in the manufacture of aircraft structural elements, said product having a composition consisting essentially of, in % by weight:

Fe<0.15;

Si<0.15;

Cu:3.8–4.4;

Mg:1–1.5;

Mn:0.5–0.8;

Zr:0.08–0.15;

other elements: <0.05 each and <0.15 total;

and formed by method steps consisting essentially of casting a plate or billet of said composition, homogenizing said plate or billet at a temperature of between 450 and 500° C., hot transforming said homogenized plate or billet by a process consisting essentially of at least one of rolling, forging or extruding, followed optionally by cold transforming, to obtain a basic product, solution heat treating said basic product, quenching said solution heat treated basic product and cold stretching said quenched basic product to obtain the product, said product having a thickness of between 6 and 60 mm, with an ultimate tensile strength $R_{m(L)}$ in the quenched an stretched temper >475 MPa and yield stress $R_{0.2}$ (L)>370 MPa, with a ratio $R_{m(L)}/R_{0.2}(L)>1.25$.

2. Product according to claim 1, wherein Fe+Si<0.15%.

3. Product according to claim 1, having a plastic range between ultimate tensile strength $R_m$ and yield stress $R_{0.2}$ in the L and TL directions in the quenched and stretched temper >100 MPa.

4. Product according to claim 1, having a critical intensity factor (L-T direction) $K_c$ in a quenched and stretched temper >170 MP√m and $K_{co}$>120 MPa√m measured according to ASTM standard E 561 on notched test pieces sampled at a quarter thickness with parameters W=500 mm, B=5 mm and $2_{BO}$=165 mm.

5. Product according to claim 1, having a crack propagation rate (L-T direction) da/dn in a quenched and stretched temper, measured according to ASTM standard E 647 on notched test pieces sampled at a quarter thickness with parameters W=200 mm and B=5 mm as follows:

$<10^{-4}$ mm/cycle for ΔK=10 MPa√m $<2.5\times10^{-4}$ mm/cycle for ΔK=15 MPa√m and $<5\times10^{-4}$ mm/cycle for ΔK=20 MPa√m.

6. Product according to claim 1, wherein deflection f, measured in L and TL directions after machining a bar supported on two supports separated by a length l to its midthickness $<(0.14\ l^2)/e$, where f is measured in microns, e is the thickness of the plate and l is length measured in mm.

7. Product according to claim 1, having an average fatigue life measured with alternating stress level of 80+55 MPa on a notched sample of thickness 40 mm taken at mid-thickness in L direction greater than 200,000 cycles.

8. Product according to claim 1, wherein Cu=4.0–4.3.

9. Product according to claim 1, wherein $R_{m(L)}/R_{0.2}(L)$ >1.30.

* * * * *